US009005146B2

(12) United States Patent
Phillips

(10) Patent No.: US 9,005,146 B2
(45) Date of Patent: Apr. 14, 2015

(54) MASSAGE ROLLER

(75) Inventor: Cassidy Phillips, Austin, TX (US)

(73) Assignee: Implus Footcare, LLC, Durham, NC (US)

( * ) Notice: Subject to any disclaimer, the term of this patent is extended or adjusted under 35 U.S.C. 154(b) by 566 days.

(21) Appl. No.: 12/657,111

(22) Filed: Jan. 13, 2010

(65) Prior Publication Data

US 2012/0065557 A1 Mar. 15, 2012

Related U.S. Application Data

(63) Continuation of application No. 12/657,111, filed on Jan. 13, 2010.

(60) Provisional application No. 61/204,822, filed on Jan. 13, 2009.

(51) Int. Cl.

| | |
|---|---|
| ***A61H 7/00*** | (2006.01) |
| ***A61H 15/00*** | (2006.01) |
| ***A63B 21/055*** | (2006.01) |
| ***A63B 21/00*** | (2006.01) |
| ***A63B 23/02*** | (2006.01) |
| ***A63B 23/035*** | (2006.01) |

(52) U.S. Cl.

CPC .... *A61H 15/0092* (2013.01); *A61H 2015/0014* (2013.01); *A61H 2201/0161* (2013.01); *A61H 2201/1261* (2013.01); *A61H 2201/1284* (2013.01); *A61H 2201/1695* (2013.01); *A61H 2203/0425* (2013.01); *A61H 2203/0443* (2013.01); *A63B 21/0552* (2013.01); *A63B 21/1484* (2013.01); *A63B 23/0222* (2013.01); *A63B 23/03541* (2013.01); *A63B 2210/50* (2013.01)

(58) Field of Classification Search

CPC ..... A61H 15/00; A61H 2015/0014; A61H 2015/0035; A61H 39/04; A61H 2201/1669; A61H 2201/169; A61H 2007/009

USPC ..... 297/217.6, 149, 217.3; 601/57, 58, 49, 601/633, 89, 90, 46, 91, 92, 93, 98–104, 601/136; D21/684; D24/211–215

See application file for complete search history.

(56) References Cited

U.S. PATENT DOCUMENTS

| | | | | | |
|---|---|---|---|---|---|
| 444,597 | A | * | 1/1891 | Archibald | 601/20 |
| 718,594 | A | * | 1/1903 | Bailey | 601/120 |
| 1,111,427 | A | * | 9/1914 | Lichtenstadt et al. | 601/119 |
| 1,688,764 | A | * | 10/1928 | Trankowski et al. | 601/120 |
| 1,780,479 | A | * | 11/1930 | Griffith | 601/131 |
| 2,079,311 | A | * | 5/1937 | Blumenthal | 606/237 |
| 2,266,859 | A | * | 12/1941 | Grampp | 601/118 |
| 2,345,438 | A | * | 3/1944 | Tompkins | 601/57 |
| 2,546,095 | A | * | 3/1951 | Gustlin | 601/121 |
| 2,728,926 | A | * | 1/1956 | Emery | 5/644 |
| 2,773,498 | A | * | 12/1956 | Himmelman | 601/98 |
| 2,785,739 | A | * | 3/1957 | McGregor, Jr. et al. | 267/145 |
| D180,564 | S | * | 7/1957 | Nakamura | D24/211 |
| 3,196,868 | A | * | 7/1965 | Johnston | 601/115 |
| 3,205,888 | A | * | 9/1965 | Stroop | 601/122 |
| 3,312,583 | A | * | 4/1967 | Rochlis | 428/88 |
| 3,389,699 | A | * | 6/1968 | Mathers | 601/52 |

(Continued)

*Primary Examiner* — Scott Medway

(74) *Attorney, Agent, or Firm* — Buchanan Ingersoll & Rooney PC

(57) ABSTRACT

A massage roller includes a generally resilient roller body and a plurality of massage zones having various densities provided on the roller body.

8 Claims, 11 Drawing Sheets

(56) References Cited

U.S. PATENT DOCUMENTS 3,415,514 A * 12/1968 Weihs ..... 482/79
3,419,268 A * 12/1968 Bellet ..... 482/132
3,548,814 A * 12/1970 Montgomery et al. ..... 601/118
3,604,026 A * 9/1971 Scheips ..... 297/397
3,645,256 A * 2/1972 Morrison ..... 601/122
3,662,748 A * 5/1972 Thurman ..... 601/121
3,664,334 A * 5/1972 O'Neil ..... 601/120
3,684,618 A * 8/1972 Geschwender ..... 56/361
3,722,113 A * 3/1973 Birkenstock ..... 36/11.5
3,885,257 A * 5/1975 Rogers ..... 5/730
4,020,519 A * 5/1977 Robison ..... 15/104.92
4,037,591 A * 7/1977 Sarno ..... 601/57
4,052,982 A * 10/1977 Ozeryansky ..... 601/121
4,067,324 A * 1/1978 Greenawalt ..... 601/120
4,070,719 A * 1/1978 Morgan ..... 5/736
4,109,649 A * 8/1978 Iyomasa ..... 601/121
4,127,116 A * 11/1978 Pannetier ..... 601/127
4,167,940 A * 9/1979 Ruf ..... 601/122
4,207,878 A * 6/1980 Duncan ..... 601/134
4,421,110 A * 12/1983 DeLisle et al. ..... 601/134
D280,337 S * 8/1985 Hood ..... D21/682
D285,117 S * 8/1986 Snyder ..... D24/211
4,741,058 A * 5/1988 Williams et al. ..... 5/691
4,744,350 A * 5/1988 Sato ..... 601/119
4,755,408 A * 7/1988 Noel ..... 428/36.5
4,782,823 A * 11/1988 Yamasaki ..... 601/127
4,845,863 A * 7/1989 Yung-Mao ..... 36/114
4,896,441 A * 1/1990 Galasso ..... 36/43
4,901,387 A * 2/1990 Luke ..... 5/730
4,936,294 A * 6/1990 Chu ..... 601/136
D310,610 S * 9/1990 Dixon ..... D6/601
D317,236 S * 6/1991 Dixon ..... D6/601
5,111,542 A * 5/1992 Farley ..... 5/727
5,123,406 A * 6/1992 Masuda ..... 601/72
5,131,383 A * 7/1992 Juarez ..... 601/19
5,135,455 A * 8/1992 King et al. ..... 482/108
D329,566 S * 9/1992 Davidson, Jr. ..... D6/601
5,160,785 A * 11/1992 Davidson, Jr. ..... 428/316.6
5,228,158 A * 7/1993 Park ..... 5/636
D343,661 S * 1/1994 Hur ..... D21/684
D346,450 S * 4/1994 Bruno ..... D24/212
5,345,990 A * 9/1994 Potts ..... 160/38
D355,322 S * 2/1995 Ackley et al. ..... D6/596
5,389,063 A * 2/1995 Wu ..... 601/135
D357,952 S * 5/1995 Chen ..... D21/684
5,411,470 A * 5/1995 Liptak et al. ..... 601/118
D361,132 S * 8/1995 Lee ..... D24/200
5,488,755 A * 2/1996 Chang ..... 16/430
5,533,953 A * 7/1996 Lui et al. ..... 482/96
5,554,102 A * 9/1996 Chiou ..... 601/72
5,575,760 A * 11/1996 Masuda ..... 601/19
5,588,953 A * 12/1996 Chang ..... 601/124
5,643,181 A * 7/1997 Lin ..... 601/112
5,675,850 A 10/1997 Schmitt
5,735,804 A * 4/1998 Chan ..... 601/136
5,766,210 A * 6/1998 Komoroczy et al. ..... 601/135
5,845,350 A * 12/1998 Beemiller et al. ..... 5/109
D414,875 S * 10/1999 Sirois et al. ..... D24/215
5,960,497 A * 10/1999 Castellino et al. ..... 5/730
6,065,210 A * 5/2000 Bove ..... 29/895.21
6,098,313 A * 8/2000 Skaja ..... 36/28
6,105,279 A * 8/2000 Bouchoms ..... 36/25 R
6,165,145 A * 12/2000 Noble ..... 601/111
6,176,841 B1 * 1/2001 Tso ..... 601/137
6,269,500 B1 * 8/2001 Saringer ..... 5/600
6,306,109 B1 * 10/2001 Polychronis ..... 601/137
6,312,400 B1 * 11/2001 Itikawa et al. ..... 601/100
6,360,388 B2 * 3/2002 Langer ..... 5/632
6,378,152 B1 * 4/2002 Washburn et al. ..... 5/713
6,419,650 B1 * 7/2002 Ryan et al. ..... 601/122
6,449,788 B1 * 9/2002 Nichols ..... 5/636
6,764,456 B1 * 7/2004 Doherty ..... 601/121
D495,422 S * 8/2004 Chen ..... D24/211
6,988,286 B2 * 1/2006 Schecter et al. ..... 5/645
7,037,278 B2 * 5/2006 Dabir ..... 601/15
D529,326 S * 10/2006 Martin et al. ..... D6/601
7,124,520 B2 * 10/2006 Galbraith et al. ..... 36/43
7,203,983 B1 * 4/2007 Reeves et al. ..... 5/636
7,250,033 B2 * 7/2007 Beiruti ..... 601/134
7,254,852 B2 * 8/2007 Martin ..... 5/636
D567,955 S * 4/2008 Fink ..... D24/200
7,387,599 B1 * 6/2008 Hsu ..... 482/132
7,500,282 B1 * 3/2009 Park ..... 15/160
D605,778 S * 12/2009 Moon ..... D24/212
D617,131 S * 6/2010 Sprouse, II ..... D6/601
7,819,828 B2 * 10/2010 Anderson ..... 601/118
D626,706 S * 11/2010 Ragonetti ..... D30/160
7,914,471 B2 * 3/2011 Chen ..... 601/99
7,918,774 B2 * 4/2011 Dye ..... 482/132
D655,056 S * 2/2012 Blair ..... D30/160
D657,065 S * 4/2012 Matsushita ..... D24/215
D660,450 S * 5/2012 Johnson ..... D24/215
2002/0119270 A1 * 8/2002 Daniel, Jr. ..... 428/36.9
2002/0193714 A1 * 12/2002 Pecora ..... 601/121
2003/0212352 A1 * 11/2003 Kahn ..... 601/98
2004/0204664 A1 * 10/2004 Chu ..... 601/121
2004/0254508 A1 * 12/2004 Lee ..... 601/119
2005/0049532 A1 * 3/2005 Lee ..... 601/118
2005/0085749 A1 * 4/2005 Baerwalde et al. ..... 601/15
2005/0102756 A1 * 5/2005 Martin ..... 5/636
2005/0148910 A1 * 7/2005 Skover et al. ..... 601/46
2005/0245851 A1 * 11/2005 Ferber et al. ..... 601/86
2006/0211962 A1 * 9/2006 Ferber et al. ..... 601/86
2006/0241537 A1 * 10/2006 Liu ..... 601/118
2008/0090707 A1 * 4/2008 Dye ..... 482/132
2008/0255484 A1 * 10/2008 Gueret ..... 601/129
2008/0262398 A1 * 10/2008 Ferber et al. ..... 601/98
2009/0131234 A1 * 5/2009 Dye ..... 482/132
2009/0312691 A1 * 12/2009 Kim et al. ..... 604/22
2013/0231594 A1 * 9/2013 Bennett ..... 601/19
2013/0261517 A1 * 10/2013 Rodgers ..... 601/121

* cited by examiner

MASSAGE ROLLER

CROSS-REFERENCE TO RELATED APPLICATIONS

This application is a Continuation of U.S. application Ser. No. 12/657,111, filed 13 Jan. 2010 ("Parent Application"). This application claims priority to U.S. Provisional Patent Application Ser. No. 61/204,822 ("Parent Provisional"), filed 13 Jan. 2009. The foregoing Parent Application and Parent Provisional are hereby incorporated by reference in their entirety as if fully set forth herein.

FIELD

The present disclosure is generally directed to massage devices. More particularly, the present disclosure is directed to a massage roller which has massage zones of various densities and is particularly effective in relieving tender and painful conditions such as muscle or connective tissue conditions and can be used as a core workout or strengthening apparatus.

BACKGROUND

The art of massage has long been used to relieve various muscle, tendon and other connective tissue ailments. The kneading of muscles, for example, imparts a modification to the muscle tissue that acts beneficially on the nerves, the muscles being controlled by the nerves in both their movement and nourishment, health of the muscle tissue due to improved blood circulation, and effusion of waste material from the muscle and connective tissues. Accordingly, numerous devices are known in the art for massaging muscles or other tissues.

Tight muscles are a common condition particularly among athletes and other active persons. Tight muscles can be caused by a variety of factors including overuse, in which small micro tears form in the muscles and cause the muscles to tighten. Poor stretching routines, particularly after physical training, may lead to muscle tightness since a muscle may adaptively shorten if it is not regularly stretched to its natural length. Bad posture can also lead to muscle tightness since improper positioning of the head or other body part may increase the work required by the muscles that support the body part.

Accordingly, a new and improved message device is needed which is particularly effective in massaging and relieving pain and discomfort associated with tight muscles as well as other muscle or connective tissue ailments such as trigger points, foot pain, Achilles tendon ailments, plantar fasciitis, calf and heel pain, and carpel tunnel syndrome, lower back pain, hip pain and thigh pain, for example and without limitation. Furthermore, a massage device is needed which has massage zones of various densities to enable a user to control the level and intensity of massage and which can be used as a core workout or strengthening apparatus.

SUMMARY

The present disclosure is generally directed to a massage roller which is particularly effective in relieving tender and painful conditions such as muscle or connective tissue conditions. An illustrative embodiment of the massage roller includes a generally resilient roller body and a plurality of massage zones having various densities provided on the roller body.

In some embodiments, the massage roller may be used as a core workout or strengthening apparatus. Generally, the apparatus may include a generally resilient roller body and a plurality of massage zones having various densities provided on the roller body. A core interior may extend through the roller body. A resilient handle connecting strap may extend through the core interior of the roller body and a pair of handles may be provided on the handle connecting strap. The handles may be gripped and resistance applied to the handle connecting strap to perform various core workout or strength training exercises. In some embodiments, a foot strap may additionally extend through the core interior of the roller body to secure the feet of a user to the roller body.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Figure 1:
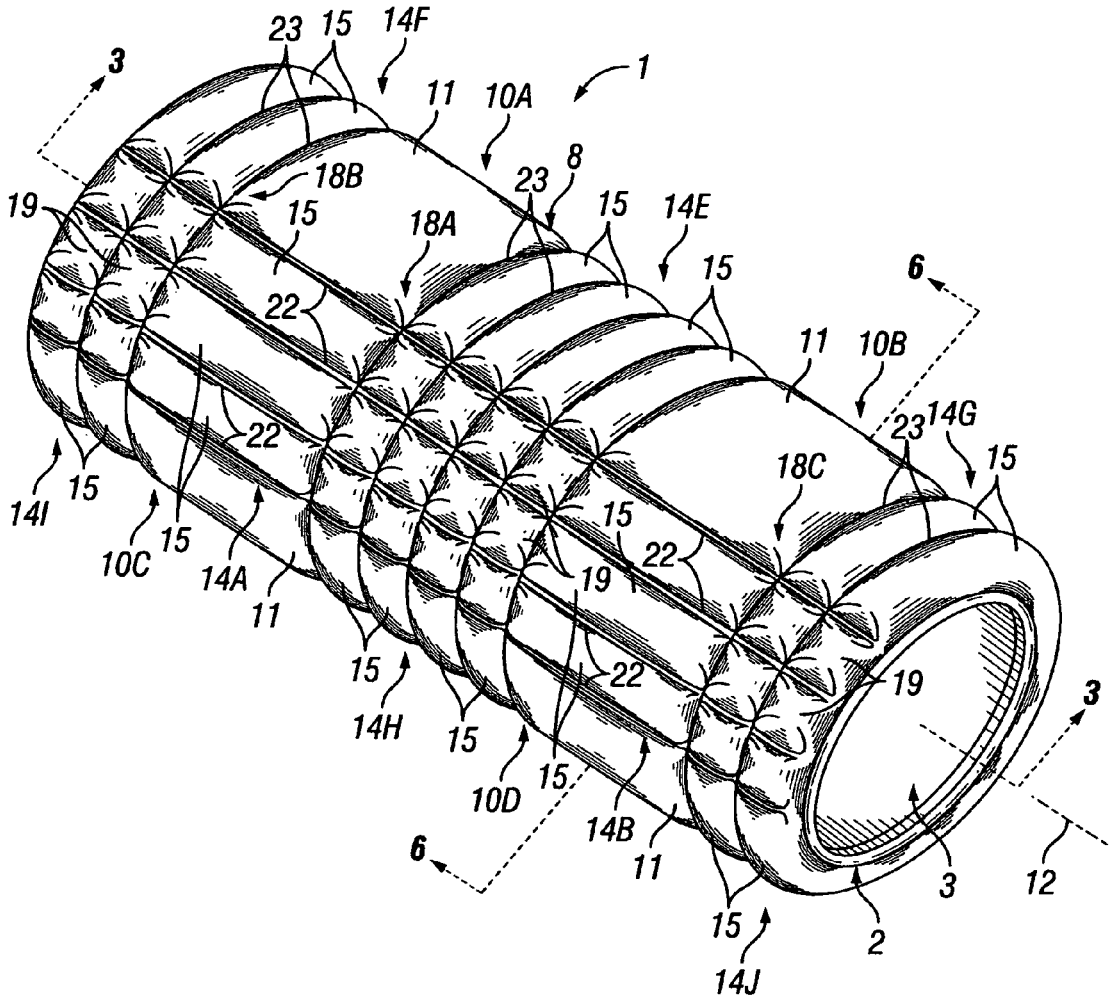
FIG. 1 is a perspective view of an illustrative embodiment of the massage roller.
Figure 2:
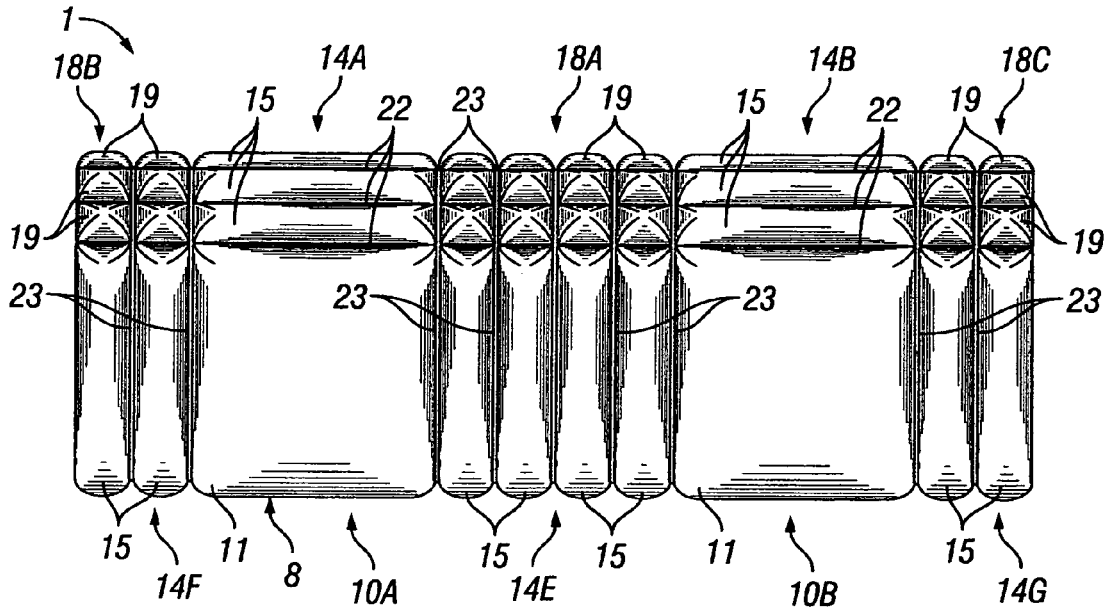
FIG. 2 is a side view of an illustrative embodiment of the massage roller.
Figure 3:
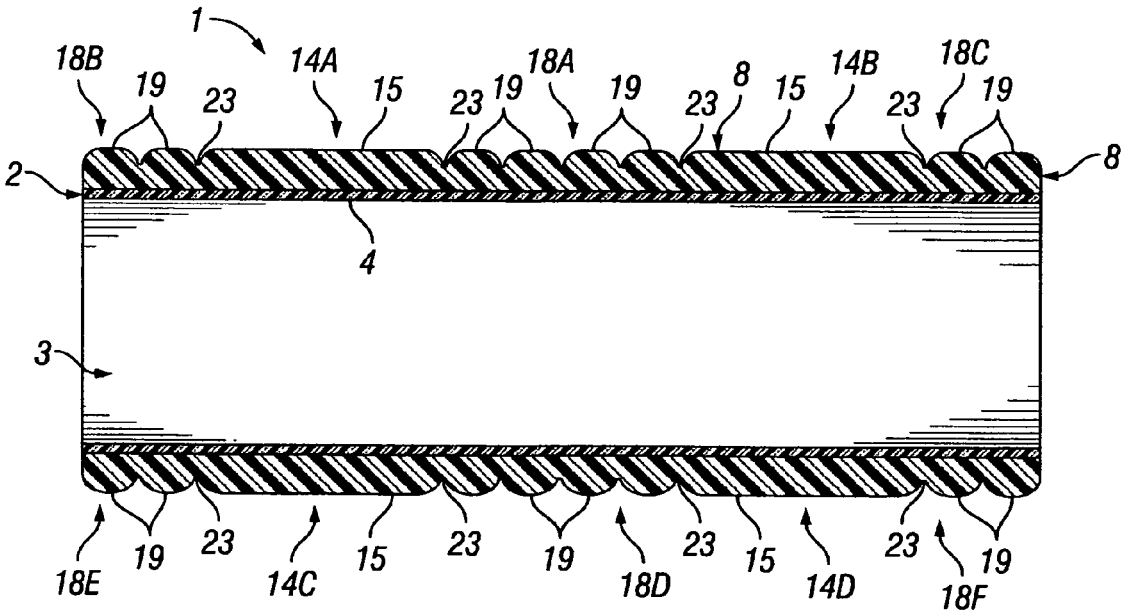
FIG. 3 is a longitudinal sectional view, taken along section lines 3-3 in FIG. 1, of an illustrative embodiment of the massage roller.

Referring initially to FIGS. 1-3 and 6 of the drawings, an illustrative embodiment of the massage roller is generally indicated by reference numeral 1. The massage roller 1 may include a roller core 2 which may be PVC (polyvinylchloride), PPE (polyphenylene) or other rigid material and may have a generally elongated, cylindrical shape. A hollow core interior 3 may extend through the roller core 2. As illustrated in FIG. 3, the roller core 2 has an exterior core surface 4.

A roller body 8 may be provided on the exterior core surface 4 of the roller core 2. The roller body 8 may have a generally elongated, cylindrical shape and may be a resilient closed cell foam or other resilient or pliant material. In any given area, the roller body 8 may be about 1~3 cm in thickness although in some embodiments the roller body 8 may be thinner or thicker. In some embodiments, the roller core 2 and the roller body 8 provided thereon may be about 13~26 inches in length. In some embodiments, the roller core 2 and the roller body 8 may be fabricated separately. The roller body 8 may be glued and/or otherwise attached to the exterior core surface 4 of the roller core 2 according to the knowledge of those skilled in the art. In other embodiments, the roller core 2 and the roller body 8 may be molded as one piece according to the knowledge of those skilled in the art.

Multiple massage zones of various densities are provided in the roller body 8 of the massage roller 1. In some embodiments, the massage zones may include at least one low-density massage zone 10; at least one medium-density massage zone 14; and at least one high-density massage zone 18. Each low-density massage zone 10 may have at least one low-density massage surface 11; each medium-density massage zone 14 may have at least one medium-density massage surface 15; and each high-density massage zone 18 may have at least one high-density massage surface 19. Accordingly, the low-density massage surface 11 of each low-density massage zone 10 is lower in density and softer to the touch than the medium-density massage surface 15 of each medium-density massage zone 14. Likewise, the medium-density massage surface 15 of each medium-density massage zone 14 is lower in density and softer to the touch than the high-density massage surface 19 of each high-density massage zone 18. In some embodiments, the softness of the low-density massage surface 11 of each low-density massage zone 10 may generally correspond to the softness of the human forearm or palm. The softness of the medium-density massage surfaces 15 of each medium-density massage zone 14 may generally correspond to the softness of the human fingers and thumb. The softness of the high-density massage surface 19 of each high-density massage zone 18 may generally correspond to the softness of human fingertips.

The low-density massage surface 11 of each low-density massage zone 10, the medium-density massage surfaces 15 of each medium-density massage zone 14 and the high-density massage surfaces 19 of each high-density massage zone 18 may be any suitable size and shape. In some embodiments, the low-density massage surface 11 of each low-density massage zone 10 may have a surface area which is greater than the surface area of each medium-density massage surface 15 of each medium-density massage zone 14. The medium-density massage surface 15 of each medium-density massage zone 14 may have a surface area which is greater than the surface area of each high-density massage surface 19 of each high-density massage zone 18.

In some embodiments, multiple longitudinal zone channels 22 may extend into the exterior surface of the roller body 8 in generally spaced-apart, parallel relationship with respect to each other and with respect to the longitudinal axis 12 (FIG. 1) of the roller body 8. Multiple circumferential zone channels 23 may extend into the exterior surface of the roller body 8 around the circumference thereof in intersecting relationship with respect to the longitudinal zone channels 22 and in generally spaced-apart, parallel relationship with respect to each other. The longitudinal zone channels 22 and the circumferential zone channels 23 may separate the low-density massage surfaces 11, the medium-density massage surfaces 15 and the high-density massage surfaces 19 from each other.

Each low-density massage zone 10 may have a single, continuous, generally rectangular low-density massage surface 11 which is bounded by a pair of longitudinal zone channels 22 and a pair of circumferential zone channels 23. Each medium-density massage zone 14 may have multiple, adjacent, parallel and generally elongated and rectangular medium-density massage surfaces 15 each of which is bounded by a pair of longitudinal zone channels 22 and a pair of circumferential zone channels 23. Each high-density massage zone 18 may have a matrix or grid of multiple, adjacent, generally square-shaped high-density massage surfaces 19 each of which is bounded by a pair of longitudinal zone channels 22 and a pair of intersecting circumferential zone channels 23.

The low-density massage zones 10, the medium-density massage zones 14 and the high-density massage zones 18 may be provided in any desired number and arranged in any suitable locations with respect to each other in the roller body 8. As illustrated in FIGS. 1-3, in some embodiments, a first set of high-density massage zones 18*a*, 18*b* and 18*c* may be provided along the longitudinal axis 12 of the roller body 8 at the center portion and the end portions, respectively, of the roller body 8. As illustrated in FIG. 3, a second set of high-density massage zones 18*d*, 18*e* and 18*f* may be provided along the longitudinal axis 12 (FIG. 1) of the roller body 8 generally in diametrically-opposed relationship with respect to the first set of high-density massage zones 18*a*, 18*b* and 18*c*, respectively. As illustrated in FIG. 3, the high-density massage surface 19 of each high-density massage zone 18 may have a generally convex cross-section.

A first pair of longitudinal medium-density massage zones 14*a* and 14*b* may be provided along the longitudinal axis 12 of the roller body 8 between the high-density massage zones 18*a*, 18*b* and 18*c* of the first set of high-density massage zones 18. As illustrated in FIG. 3, a second pair of longitudinal medium-density massage zones 14*c* and 14*d* may be provided along the longitudinal axis 12 of the roller body 8 between the high-density massage zones 18*d*, 18*e* and 18*f* of the second set of high-density massage zones 18. The second pair of longitudinal medium-density massage zones 14*c* and 14*d* may be disposed generally in diametrically-opposed relationship with respect to the first pair of longitudinal medium-density massage zones 14*a* and 14*b*, respectively, as further illustrated in FIG. 3. As illustrated in FIGS. 1 and 2, the medium-density massage surface 15 of each of the first pair of longitudinal medium-density massage zones 14*a* and 14*b* and of each of the second pair of longitudinal medium-density massage zones 14*c* and 14*d* (FIG. 3) may be generally elongated, rectangular and oriented in generally parallel relationship with respect to the longitudinal axis 12 (FIG. 1) of the roller body 8 and may have a generally convex cross-section (FIG. 6).

As illustrated in FIGS. 1 and 2, a first set of semi-circumferential medium-density massage zones 14*e*, 14*f* and 14*g* may extend between the first set of high-density massage zones 18*a*, 18*b* and 18*c* on one side of the roller body 8 and the second set of high-density massage zones 18*d*, 18*e* and 18*f*, respectively, on the opposite side of the roller body 8. A second set of semi-circumferential medium-density massage zones 14*h*, 14*i* and 14*j* may extend between the second set of high-density massage zones 18*d*, 18*e* and 18*f* and the first set of high-density massage zones 18*a*, 18*b* and 18*c*, respectively, in generally diametrically-opposed relationship to the first set of semi-circumferential medium-density massage zones 14*e*, 14*f* and 14*g*. The medium-density massage surface 15 of each of the first set of semi-circumferential medium-density massage zones 14*e*, 14*f* and 14*g* and the medium-density massage surface 15 of each of the second set of semi-circumferential medium-density massage zones 14*h*, 14*i* and 14*j* may have an elongated, curved and convex shape.

Figure 6:
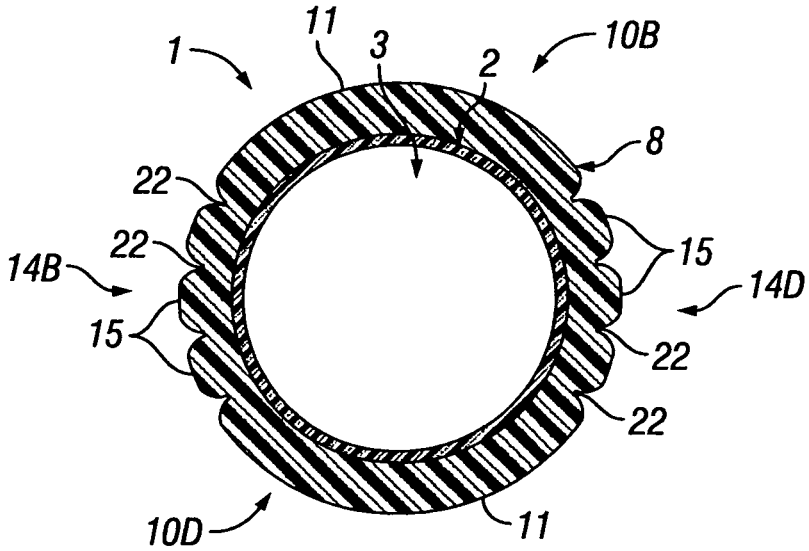
FIG. 6 is a cross-sectional view, taken along section lines 6-6 in FIG. 1, of an illustrative embodiment of the massage roller.

As illustrated in FIGS. 1, 2 and 6, a first pair of semi-circumferential low-density massage zones 10*a* and 10*b* may be interspersed among the first set of semi-circumferential medium-density massage zones 14*e*, 14*f* and 14*g*. The semi-circumferential low-density massage zone 10*a* may extend between the longitudinal medium-density massage zone 14*a* on one side and the longitudinal medium-density massage zone 14*c* (FIG. 3) on the other side of the roller body 8. The semi-circumferential low-density massage zone 10*b* may extend between the longitudinal medium-density massage zone 14*b* on one side and the longitudinal medium-density massage zone 14*d* (FIG. 3) on the other side of the roller body 8.

A second pair of semi-circumferential low-density massage zones 10*c* and 10*d* may be interspersed among the second set of semi-circumferential medium-density massage zones 14*h*, 14*i* and 14*j*. The semi-circumferential low-density massage zone 10*c* may extend between the longitudinal medium-density massage zone 14*c* (FIG. 3) on one side and the longitudinal medium-density massage zone 14*a* on the other side of the roller body 8. The semi-circumferential low-density massage zone 10*d* may extend between the longitudinal medium-density massage zone 14*d* (FIG. 3) on one side and the longitudinal medium-density massage zone 14*b* on the other side of the roller body 8. As illustrated in FIG. 6, the low-density massage surface 11 of each low-density massage zone 10 may have a generally convex cross-section.

Figure 4:
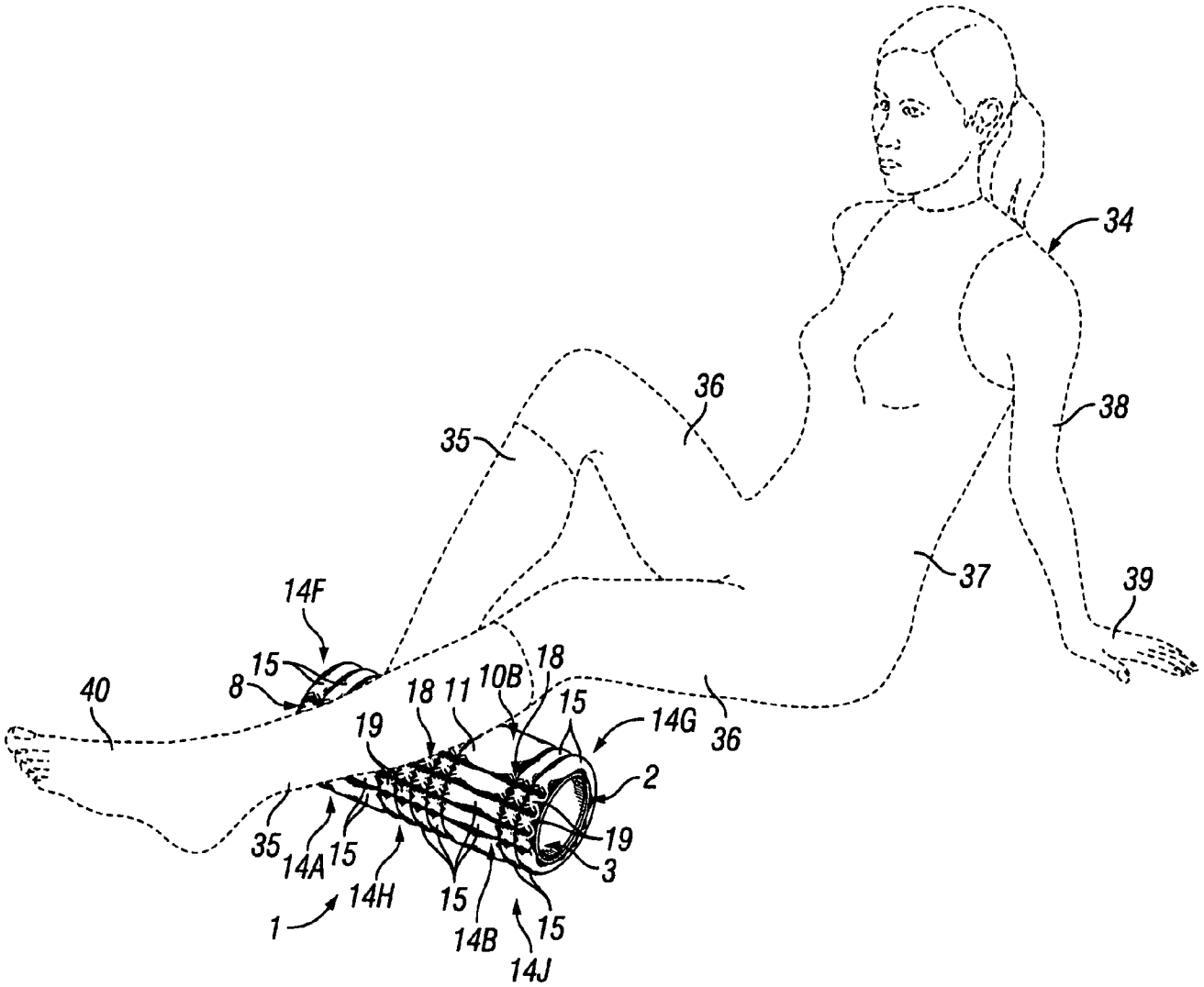
FIG. 4 is a perspective view of an illustrative embodiment of the massage roller being used to massage the lower leg of a user (illustrated in phantom)
Figure 5:
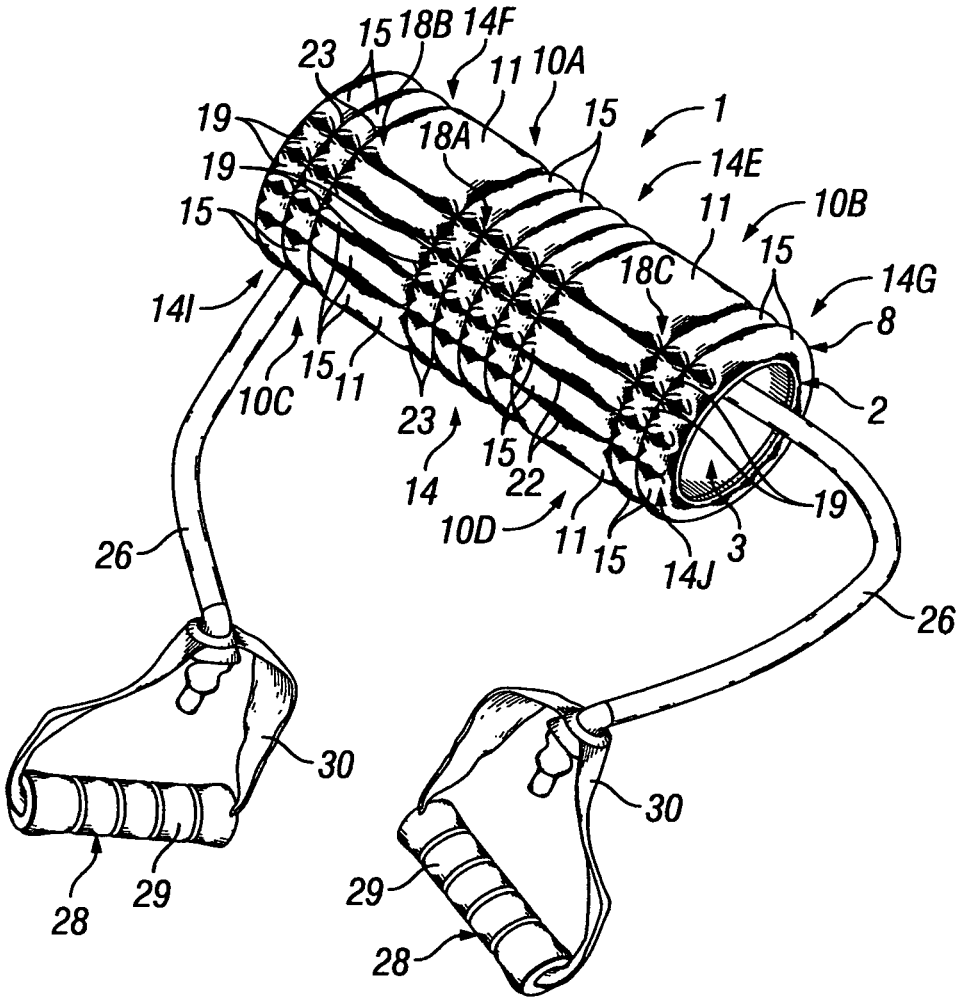
FIG. 5 is a perspective view of an illustrative embodiment of the massage roller, with a handle connecting strap extending through the massage roller and handles provided on respective ends of the handle connecting strap.

Referring next to FIG. 4 of the drawings, an exemplary use of the massage roller 1 is illustrated. The message roller 1 may be used to massage muscles in the lower leg 35 of a user 34, as illustrated, for the purpose of relieving pain and discomfort associated with tight muscles in the user's lower leg 35, for example and without limitation. Accordingly, the massage roller 1 is placed on a floor or other supporting surface (not illustrated). The user 34 sits on the floor or other surface and places his or her lower leg 35 on the massage roller 1. The user 34 may place his or her lower leg 35 against a low-density massage zone 10, a medium-density massage zone 14 and/or a high-density massage zone 18 of the massage roller 1. Next, while applying the lower leg 35 against the massage roller 1 with a selected magnitude of pressure, the user 34 repeatedly moves the lower leg 35 in a back-and-forth motion against the massage roller 1 as the massage roller 1 rolls on the floor or surface. Therefore, the low-density massage zones 10; the medium-density massage ones 14; and/or the high-density massage zones 18 on the massage roller 1 massage the muscles in the lower leg 35, relieving the pain and discomfort associated with the tight muscles in the lower leg 35.

It will be appreciated by those skilled in the art that the variation in densities of the low-density massage zones 10, the medium-density massage zones 14 and the high-density massage zones 18 on the massage roller 1 enables the user 34 to achieve a high degree of selectivity and control in the level, intensity and location of the massaging action which is imparted by the massage roller 1 against the user's lower leg 35 or other area of the body. For example, massaging action which would be implemented using the human forearm or palm of a masseuse can be mimicked by rolling the lower leg 35 against one of the low-density massage zones 10 on the massage roller 1. Massaging action which could be implemented using the human fingers and thumb can be mimicked by rolling the lower leg 35 against one of the medium-density massage zones 14 on the massage roller 1. Massaging action which could be implemented using human finger tips can be mimicked by rolling the lower leg 35 against one of the high-density massage zones 18. It will be further appreciated by those skilled in the art that the massage roller 1 can be used to massage any portion on the body of the user 34 including the upper leg 36, the torso 37, the arms 38, the hands 39 and the feet 40, for example and without limitation. Moreover, due to the typically closed foam cell construction of the roller body 8, the massage roller 1 is durable and resistant to breakdown and loss in shape, eliminating the need for costly replacement as a result of day-to-day use. The massage roller 1 can be used as part of a daily massage routine or can be integrated into athletic activities to help support and achieve a comprehensive core workout.

It will be further appreciated by those skilled in the art that the presence of the longitudinal zone channels 22 and the circumferential zone channels 23 in the roller body 8 of the massage roller 1 facilitate channeling of blood and oxygen through the muscles and other connective tissues of the user 34 which are being massaged since the low-density massage zones 10, the medium-density massage zones 14 and the high-density massage zones 18 force the blood and oxygen from the areas of the tissues against which the massage zones are rolled into the adjacent areas of the tissues which correspond to the locations of the zone channels 22, 23. The channels in the tissues through which the blood and oxygen flow are created by the lines or zone channels 22, 23 in the massage zones such that the blood and oxygen can travel in the areas of the tissue which are not compressed by the foam structure of the massage zones. Moreover, conventional massage devices have a low coefficient of friction between the user and the massage device and the massage device and the floor, wall or other supporting surface. Therefore, conventional massage rollers may not be suitable for being rolled against the skin of the user and also may not be capable of compressing body tissues against the bone of the user as effectively as the massage roller 1.

Figure 7:
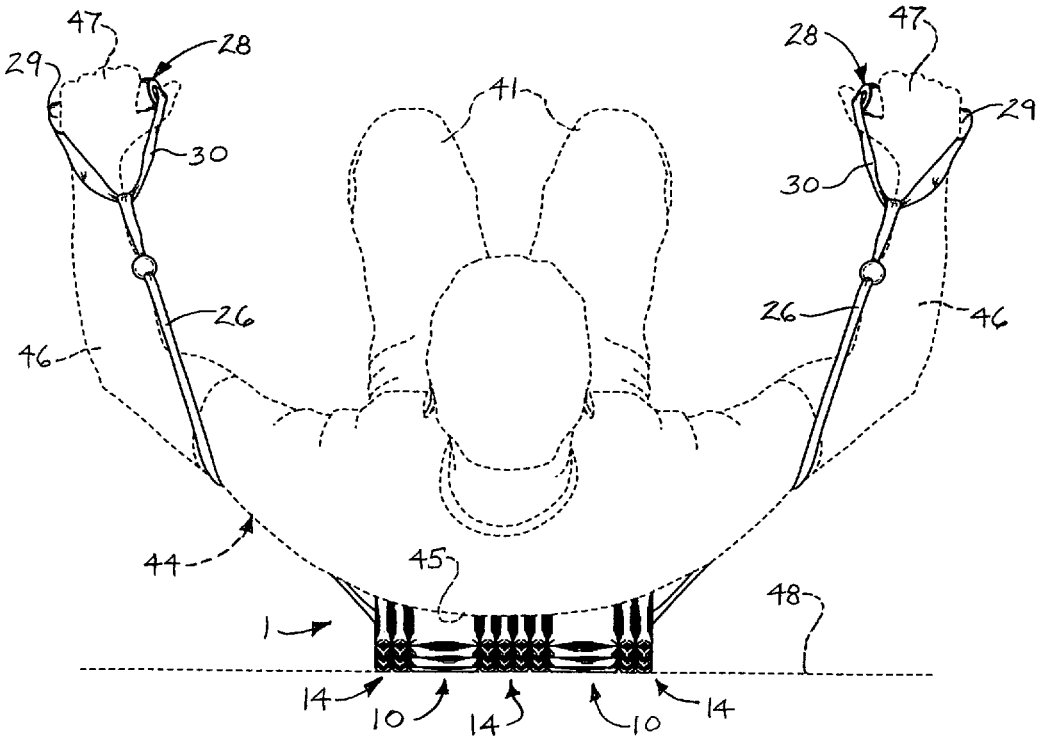
FIG. 7 is a side view of an illustrative embodiment of the massage roller utilized in a type of full-body workout in which a user lies on the massage roller, grips the handles and exercises the user's arms by pushing against the handle connecting straps.
Figure 8:
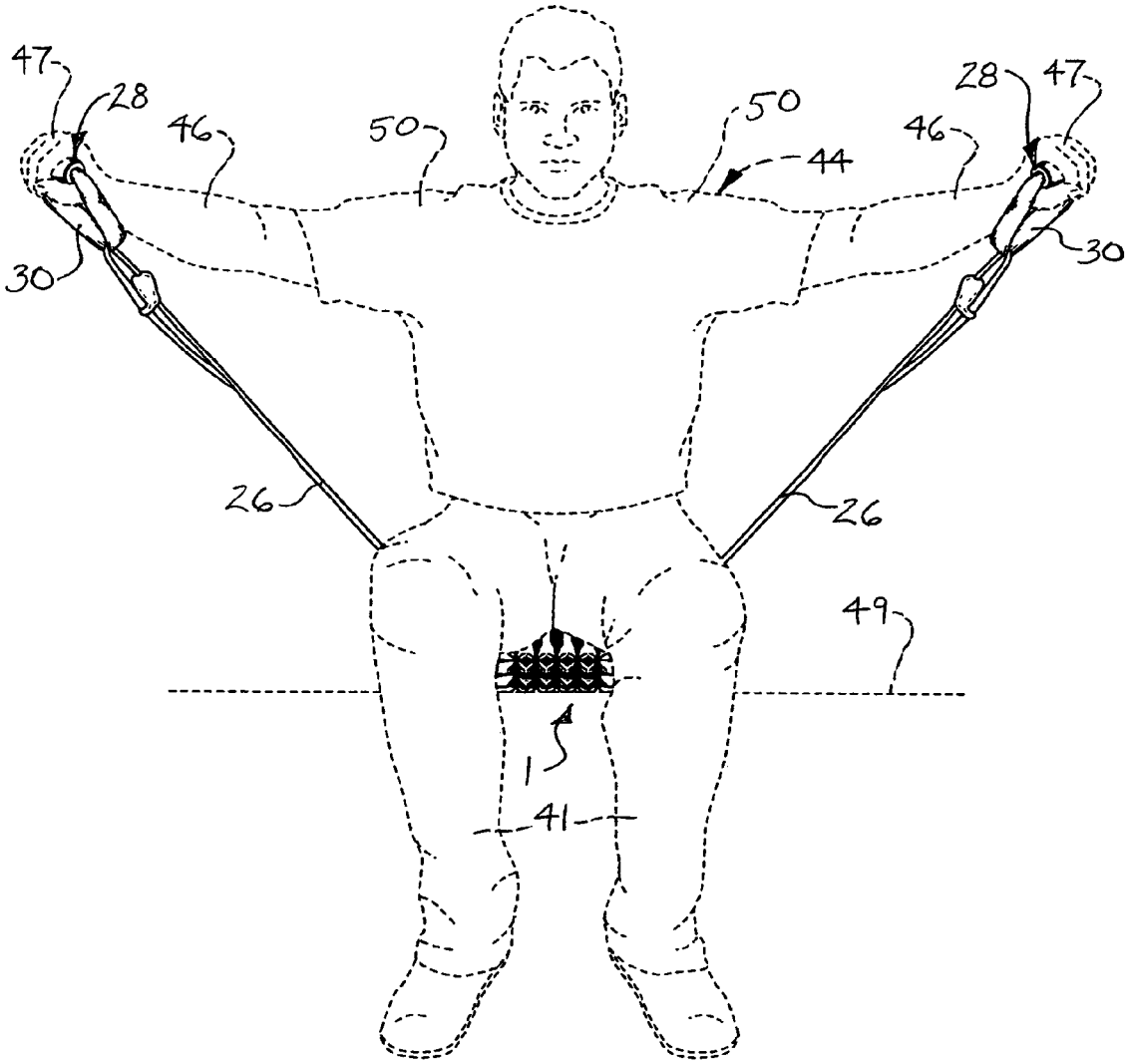
FIG. 8 is a side view of an illustrative embodiment of the massage roller utilized in a type of full-body workout in which a user sits on the massage roller, grips the handles and exercises the user's arms by pushing against the handle connecting straps.
Figure 9:
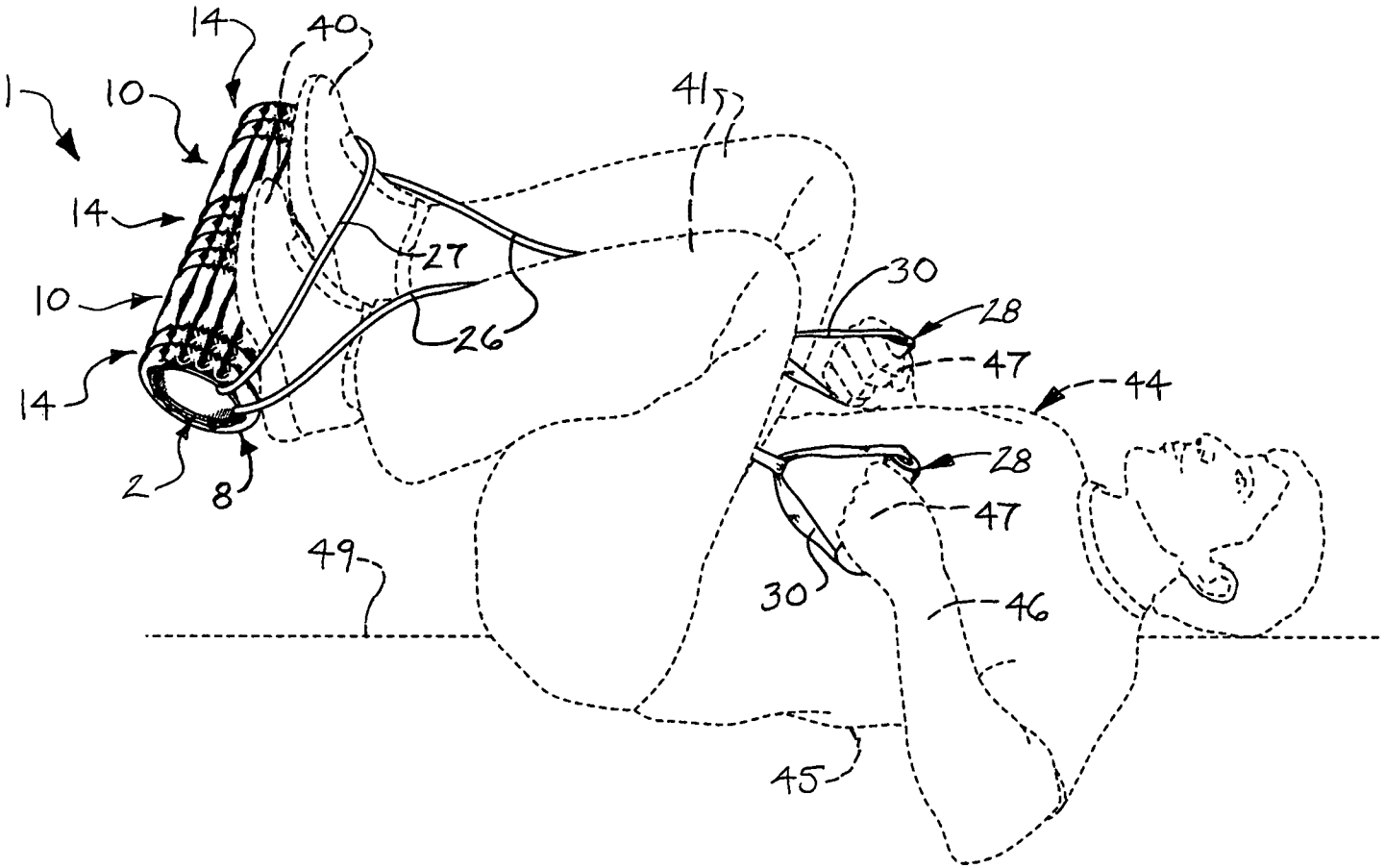
FIG. 9 is a perspective view of an illustrative embodiment of the massage roller utilized in a type of full-body workout in which a user rests on the user's back, places the massage roller against the bottom of the user's feet, grips the handles and exercises the user's legs by pushing against the handle connecting straps.

Referring next to FIGS. 5 and 7-9 of the drawings, in some applications of the massage roller 1, an elongated, flexible, elastic or resilient handle connecting strap 26 may be extended through the core interior 3 of the roller core 2. Handles 28 may be provided on respective ends of the handle connecting strap 26. Each handle 28 may include a handle grip 29 which is attached to the handle connecting strap 26 by a handle attachment strap 30. Accordingly, as illustrated in FIGS. 7-9, the massage roller 1 can be implemented in a variety of full-body workout resistance exercises in which a user 44 grips the handles 28 and pushes or pulls against the tension exerted by the handle connecting strap 26. As illustrated in FIG. 7, in one type of full-body workout exercise, the user 44 places the massage roller 1 on the floor 48 or other supporting surface. The user 44 places his or her back 45 on the massage roller 1, grips the handles 28 with his or her hands 47 and exercises his or her arms 46 by repeatedly pushing against the resistance imparted by the handle connecting straps 26. As illustrated in FIG. 8, in another type of full-body workout exercise, the user 44 places the massage roller 1 on a chair or other elevated support 49. The user 44 sits on the massage roller 1, grips the handles 28 with his or her hands 47 and exercises his or her arms 46 and shoulders 50 by moving his or her arms 46 outwardly from the user's body. As illustrated in FIG. 9, in still another type of full-body workout exercise, the user 44 lies on the floor 49 or other surface and places his or her feet 40 on the massage roller 1 with the handle connecting straps 26 extending between the user's legs 41. A foot strap 27 may extend through the core interior 3 of the roller core 2 and placed over the user's feet 40 to secure the user's feet 40 to the roller body 8. The user 44 grips the handles 28 and pushes the massage roller 1 by extending his or her legs 41 against the resistance applied by the handle connecting strap 26. Numerous other resistance exercises are possible using the massage roller 1 with handle connecting strap 26 and handles 28 to provide the user 44 with a full-body workout in which muscles in all parts of the user's body can be exercised.

Figure 10:
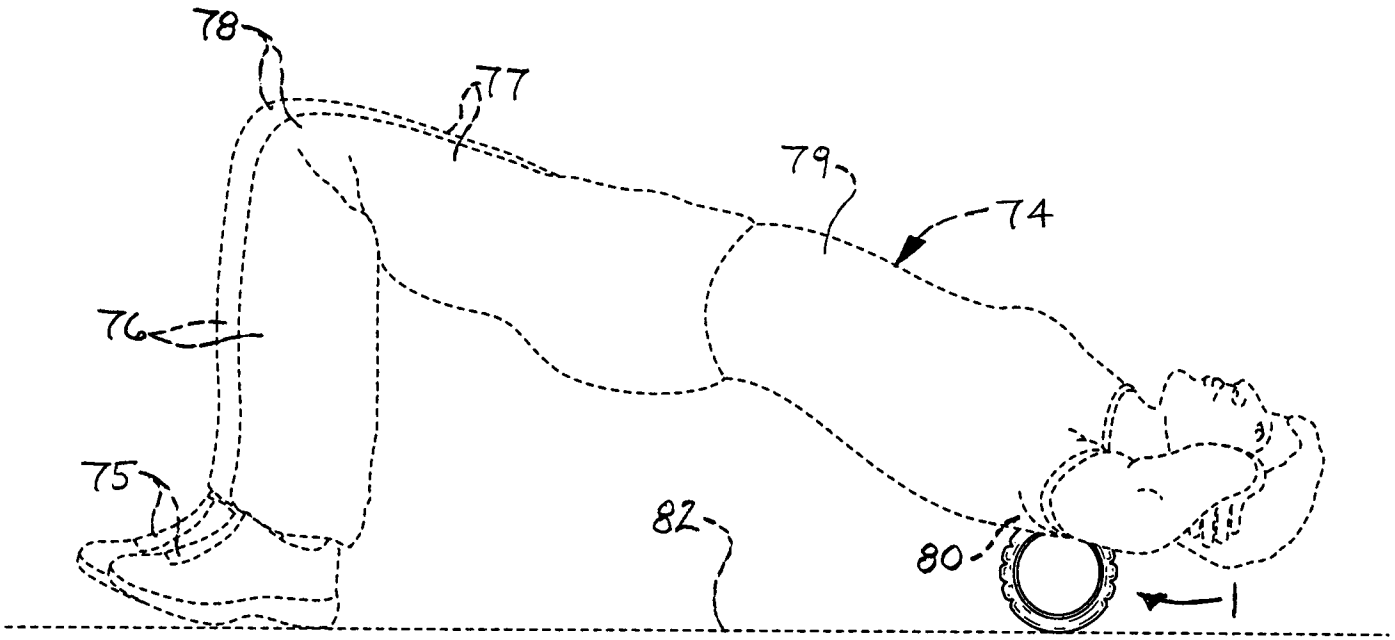
FIG. 10 is a side view of an illustrative embodiment of the massage roller utilized in a core workout in which a user places the massage roller on a floor or other support surface, rests his or her upper back on the massage roller, places his or her feet flat on the floor and tensions the upper legs and abdomen.
Figure 11:
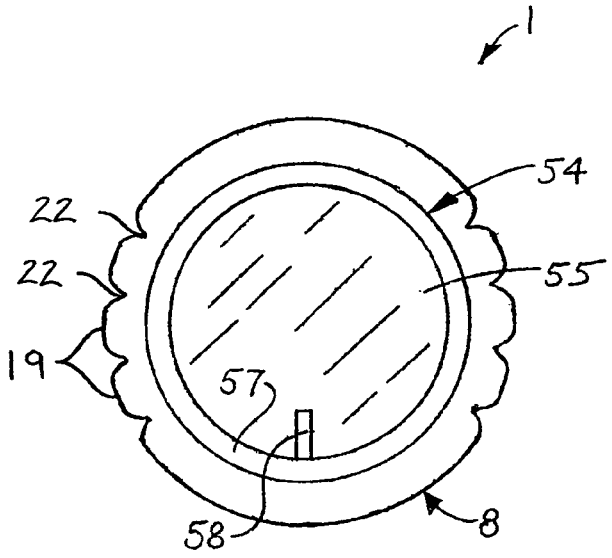
FIG. 11 is an end view of an illustrative embodiment of the massage roller, with a roller end cap inserted in an end of the massage roller.
Figure 12:
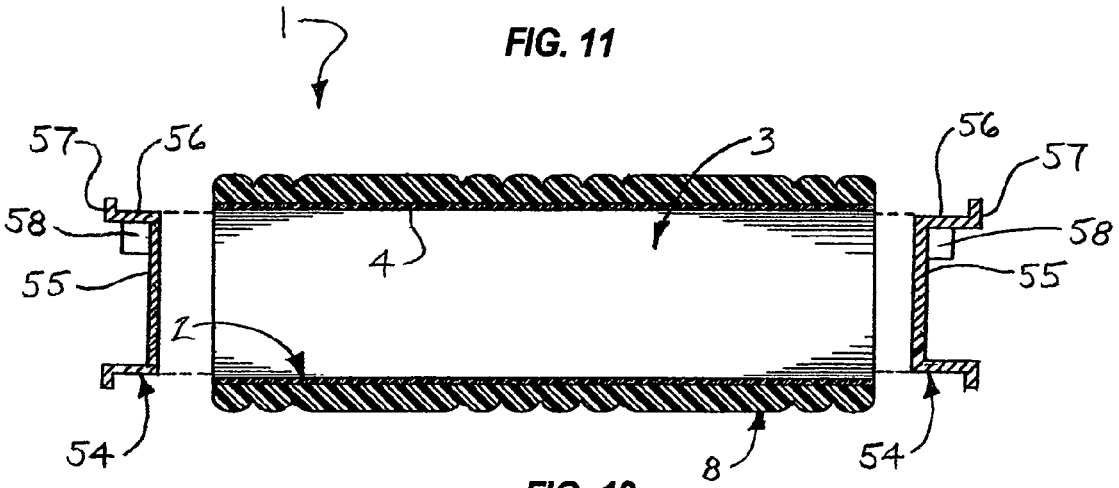
FIG. 12 is an exploded longitudinal sectional view of the massage roller illustrated in FIG. 11, more particularly illustrating insertion of the roller end caps into the respective ends of the massage roller.

Referring next to FIG. 10 of the drawings, in some applications, the massage roller 1 can be placed between a floor or other supporting surface 82 and the feet 75, lower legs 76, upper legs 77, knees 78, abdomen 79, upper back 80 or other portion of the body of a user 74. The massage roller 1 acts as a fulcrum on which the body weight of the user 74 can be balanced or partially balanced and enables the user 74 to perform a variety of core exercises which engage the muscles of the legs, back, abdomen or other parts of the body at various levels of intensity. In the example which is illustrated in FIG. 10, the massage roller 1 is placed on the floor or other supporting surface 82 and the upper back 80 of the user 74. The feet 75 of the user 74 are placed flat on the supporting surface 82, with the lower legs 76 generally vertical and the upper legs 77 bent at the knees 78. The upper legs 77 and the abdomen 79 are raised over the supporting surface 82. Accordingly, the massage roller 1 acts as a fulcrum in which the user can alternately raise and lower the upper legs 77 and the abdomen 79 to exercise abdominal muscles such as the external and internal oblique muscles as well as muscles in the legs and back. During performance of the exercises, the massage zones 10, 14 and 18 provide a grip surface between the upper back 80 of the user 74 and the massage roller 1 and also between the massage roller 1 and the supporting surface 82. Moreover, the massage zones 10, 14 and 18 may additionally massage the upper back 80 and/or the other areas on the user 74 which the massage roller 1 contacts. In other applications, the massage roller 1 can be placed against a wall (not illustrated) and the user's back placed against the massage roller 1 as the user performs squats. Accordingly, as the user raises and lowers the buttocks, the massage roller 1 provides support to the user's back while massaging the back and providing core work to the legs and other parts of the user's body. In still other applications, the massage roller 1 can be placed between the support surface 82 and the feet 75, lower legs 76, knees 78, upper legs 77, abdomen 79 or other area of the user 74 and used as a fulcrum against which the user performs push-ups of various intensity depending on the location of the massage roller 1. The massage zones 10, 14 and 18 provide a grip surface between the user 74 and the massage roller 1 and also between the massage roller 1 and the supporting surface 82 and may additionally massage the area on the user 74 which the massage roller 1 contacts.

Throughout performance of the core workout exercises, the presence of the longitudinal zone channels 22 and the circumferential zone channels 23 in the roller body 8 of the massage roller 1 facilitate channeling of blood and oxygen through the muscles and other connective tissues of the user 74 which are being massaged since the low-density massage zones 10, the medium-density massage zones 14 and the high-density massage zones 18 force the blood and oxygen from the areas of the tissues against which the massage zones are rolled into the adjacent areas of the tissues which correspond to the locations of the zone channels 22, 23. The channels in the tissues through which the blood and oxygen flow are created by the lines or zone channels 22, 23 in the massage zones such that the blood and oxygen can travel in the areas of the tissue which are not compressed by the foam structure of the massage zones.

Figure 13:
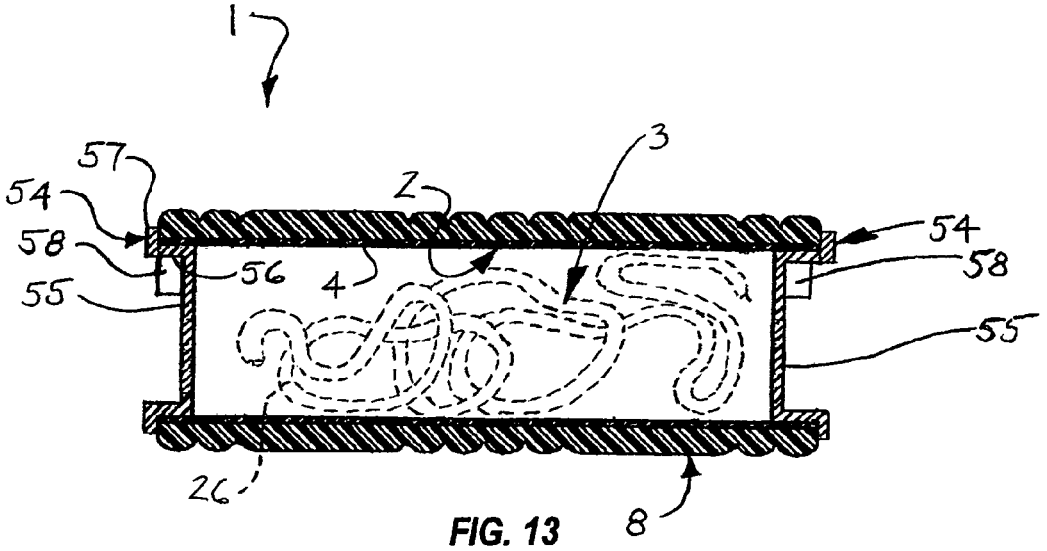
FIG. 13 is a longitudinal sectional view of the massage roller illustrated in FIG. 11, with the roller end caps inserted into the respective ends of the massage roller and a handle connecting strap (illustrated in phantom) stored in the interior of the massage roller.

Referring next to FIGS. 11-17 of the drawings, in some embodiments of the massage roller 1, a pair of roller end caps 54 may be removably inserted into the respective ends of the roller core 2. In some embodiments, each roller end cap 54 may include a generally flat or planar cap plate 55. An annular cap wall 56 may extend from the cap plate 55. An annular cap flange 57 may extend outwardly from the cap wall 56. The diameter of the cap wall 56 of each roller end cap 54 may be sized to friction fit into the end of the core interior 3 until the cap flange 57 engages the end of the roller core 2, as illustrated in FIG. 13. A cap tab 58 may be provided on each roller end cap 54 to provide a grip surface for manual insertion and removal of each roller end cap 54 in the corresponding end of the core interior 3. As illustrated in FIG. 13, in some applications the handle connecting strap 26 (FIG. 9) to which the handles 28 are normally attached may be inserted and stored in the core interior 3 of the roller core 2 after detachment of the handles 28 from the handle connecting strap 26. The roller end caps 54 may then be inserted into the respective ends of the roller core 2 to enclose the handle connecting strap 26 in the core interior 3 of the roller core 2. The foot strap 27 (FIG. 9) may be similarly stored in the core interior 3 of the roller core 2. It will be recognized and understood that each roller end cap 54 may have any design which is suitable to facilitate removable insertion of the roller end cap 54 into the corresponding end of the roller core 2.

Figure 14:
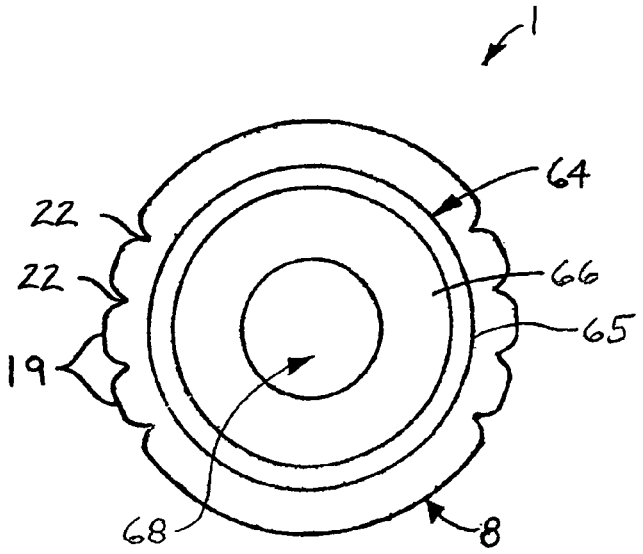
FIG. 14 is an end view of an illustrative embodiment of the massage roller, with an alternative roller end cap inserted in one end of the massage roller.
Figure 15:
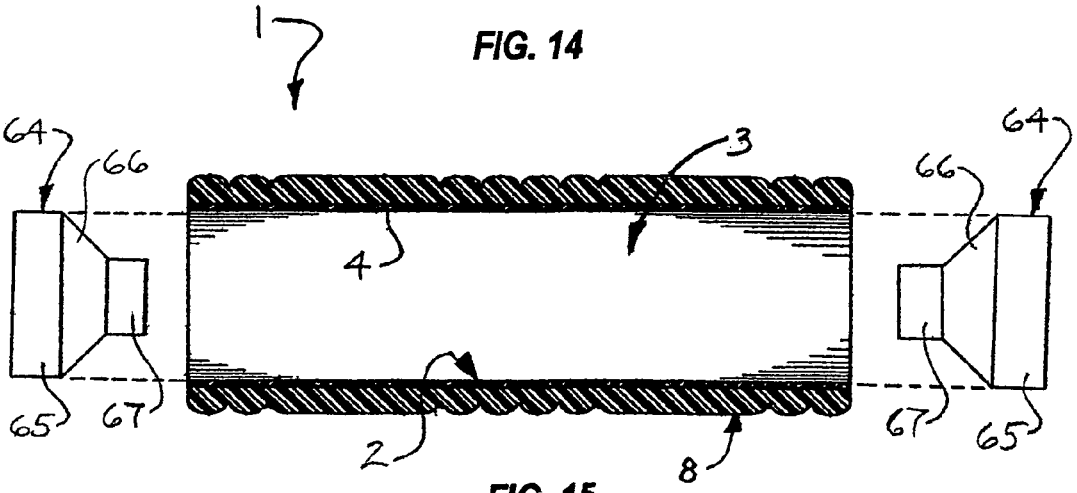
FIG. 15 is an exploded longitudinal sectional view of the massage roller illustrated in FIG. 14, more particularly illustrating insertion of the roller end caps into the respective ends of the massage roller.
Figure 16:
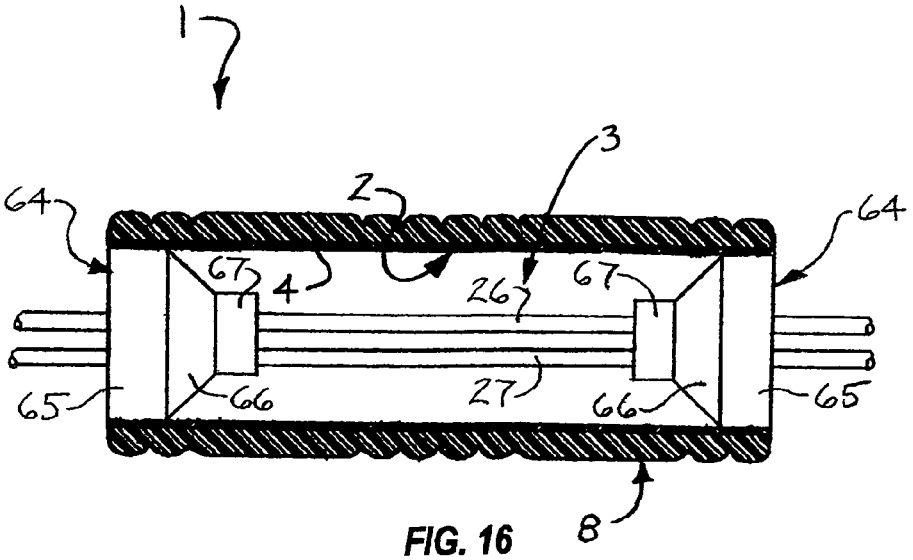
FIG. 16 is a longitudinal sectional view of the massage roller illustrated in FIG. 14, with the roller end caps inserted into the respective ends of the massage roller and a handle connecting strap and a foot strap extending through each roller end cap.
Figure 17:
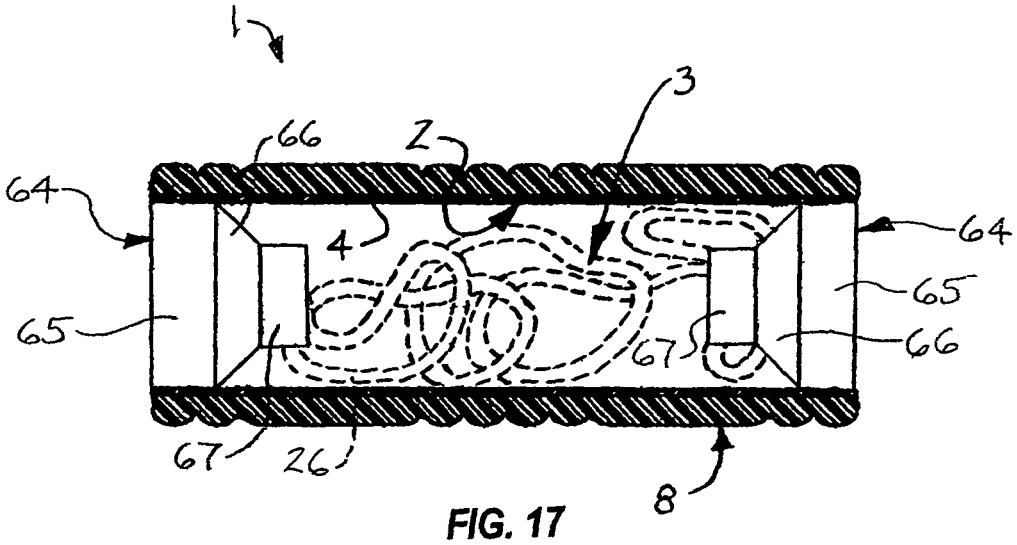
FIG. 17 is a longitudinal sectional view of the massage roller illustrated in FIG. 14, with the roller end caps inserted into the respective ends of the massage roller and a handle connecting strap (illustrated in phantom) stored in the interior of the massage roller.

Referring next to FIGS. 14-17 of the drawings, an alternative roller end cap 64 which is suitable for closing the ends of the roller core 2 is illustrated. In some embodiments, each roller end cap 64 may include an annular end cap body 65. A funnel-shaped middle cap portion 66 may extend from the end cap body 65. An annular inner cap portion 67 may extend from the middle cap portion 66. As illustrated in FIG. 14, a central cap opening 68 may extend through the end cap body 65, the middle cap portion 66 and the inner cap portion 67. Accordingly, as illustrated in FIGS. 15 and 16, the end cap body 65 of each roller end cap 64 may be friction fitted into the corresponding end of the roller core 2 of the massage roller 1 with the middle cap portion 66 and the inner cap portion 67 protruding into the core interior 3. In application of the massage roller 1 as was heretofore described with respect to FIGS. 7-9 of the drawings, the handle connecting strap 26 and the foot strap 27 can be extended through the cap opening 68 (FIG. 14) of each roller end cap 64 and through the core interior 3 of the roller core 2. When the massage roller 1 is not in use, the handles 28 can be detached from the respective ends of the handle connecting strap 26 and the handle connecting strap 26 and the foot strap 27 stored in the core interior 3 of the roller core 2, as illustrated in FIG. 17.

While illustrative embodiments of the disclosure have been described above, it will be recognized and understood that various modifications can be made and the appended claims are intended to cover all such modifications which may fall within the spirit and scope of the disclosure.

What is claimed is:

1. A massage roller comprising:

a single, generally elongated, cylindrical roller core having:

a first axial end, a second axial end, and a core length extending between the first and second axial ends;

a hollow core interior extending the core length and forming an inner core surface having an inner core radius and an inner core diameter twice the inner core radius;

an exterior core surface having an exterior core radius; and a core thickness extending radially between the inner core surface and the exterior core surface; and a roller body provided on the roller core comprising a plurality of curvilinear massage zones distributed substantially continuously, both radially and axially, on the exterior core surface, each massage zone having:

a selected one of a first softness and a second softness;

a substantially continuous, both radially and axially, massage surface having an exterior zone radius and an exterior zone diameter twice the exterior zone radius; and a zone thickness extending radially between the exterior core surface and the massage surface;

wherein:

the sum of the core thickness and the zone thickness is less than the inner core radius; and the core length is greater than the exterior zone diameter.

2. The massage roller of claim 1 wherein:

a first one of the massage zones has the first softness; and a second one of the massage zones has the second softness.

3. The massage roller of claim 1 wherein:

the first softness is of predetermined softness; and the second softness is softer than the first softness.

4. The massage roller of claim 1 wherein the roller body is further characterized as having:

a selected one of the first softness, the second softness and a third softness;

wherein:

a first one of the massage zones has the first softness;

a second one of the massage zones has the second softness; and a third one of the massage zones has the third softness.

5. The massage roller of claim 4 wherein:

the first softness is of predetermined softness;

the second softness is softer than the first softness; and the third softness is softer than the second softness.

6. The massage roller of claim 1 wherein:

a first one of the massage zones comprises a single generally rectilinear first structure curvilinearly conformant with the exterior core surface; and a second one of the massage zones comprises a plurality of generally rectilinear second structures curvilinearly conformant with the exterior core surface, each of which is smaller in at least one curvilinear dimension that the first structure.

7. The massage roller of claim 4 wherein:

a first one of the massage zones comprises a single generally rectilinear first structure curvilinearly conformant with the exterior core surface;

a second one of the massage zones comprises a plurality of generally rectilinear second structures curvilinearly conformant with the exterior core surface, each of which is smaller in at least one curvilinear dimension that the first structure; and a third one of the massage zones comprises a plurality of generally rectilinear third structures curvilinearly conformant with the exterior core surface, each of which is smaller in two curvilinear dimensions that the first structure.

8. The massage roller of claim 1 wherein the core length is on the order of about 12 inches.

* * * * *